US006089787A

United States Patent [19]

Allen et al.

[11] Patent Number: 6,089,787

[45] Date of Patent: Jul. 18, 2000

[54] TRANSFORMABLE TWO-PERSON FLOATING SCREED WITH AUTOMATIC GRADE CONTROL

[75] Inventors: J. Dewayne Allen; Timmy D. Guinn, both of Paragould, Ark.

[73] Assignee: Allen Engineering Corp., Paragould, Ark.

[21] Appl. No.: 09/084,282

[22] Filed: May 26, 1998

[51] Int. Cl.[7] ..... E01C 19/22

[52] U.S. Cl. ..... 404/118

[58] Field of Search ..... 404/97, 114, 118

[56] References Cited

U.S. PATENT DOCUMENTS

| | | | |
|---|---|---|---|
| 2,599,330 | 6/1952 | Jackson | 404/114 |
| 4,386,901 | 6/1983 | Morrison | 425/456 |
| 4,591,291 | 5/1986 | Owens | 404/118 |
| 4,752,156 | 6/1988 | Owens | 404/118 |
| 4,798,494 | 1/1989 | Allen | 404/114 |
| 4,838,730 | 6/1989 | Owens | 404/114 |
| 5,130,794 | 7/1992 | Ritchey | 358/87 |
| 5,190,401 | 3/1993 | Wilson | 404/118 |
| 5,288,166 | 2/1994 | Allen et al. | 404/84.1 |
| 5,429,494 | 7/1995 | Kuehn | 431/91 |
| 5,549,413 | 8/1996 | Bolden | 404/93 |
| 5,567,075 | 10/1996 | Allen | 404/84.5 |

FOREIGN PATENT DOCUMENTS

| | | | |
|---|---|---|---|
| 2224057 | 4/1990 | United Kingdom | 404/97 |

*Primary Examiner*—Eileen Dunn Lillis
*Assistant Examiner*—Gary S. Hartmann
*Attorney, Agent, or Firm*—Stephen D. Carver

[57] ABSTRACT

A two-person floating screed with laser-operated, automatic grade control apparatus for finishing plastic concrete is transformable for different operations. A rigid, transversely oriented float mounts a strikeoff for initially contacting and leveling rough, freshly poured concrete. In one form of the invention the screed merely floats upon the concrete surface. In an alternative embodiment, lightweight ski assemblies support the screed over the subgrade. The skis secure upwardly projecting screw jacks that removably couple to the screed and control elevation of the transverse float in response to laser signals. Each worker has a separate handle mechanism pivotally associated with the float. Separate, light-weight power sources are carried by each worker in a suitable backpack to power the screw jacks. Laser sensors mounted on vibration dampened stanchions emanating from the float respond to external laser beacons and display grade information so that the workers can make manual adjustments. With the ski assemblies attached, the laser system automatically controls float elevation by activating the screw jacks so that the extend or contract. The float preferably comprises twin sections that are secured together in the two person mode. When uncoupled, the float divides into a pair of separate, compact one-person floating screeds.

2 Claims, 6 Drawing Sheets

TRANSFORMABLE TWO-PERSON FLOATING SCREED WITH AUTOMATIC GRADE CONTROL

BACKGROUND OF THE INVENTION

1. Field of the Invention

This invention relates generally to floating, vibrating screeds for striking off and consolidating freshly poured concrete. More particularly, our invention relates to a portable, dual-operator screed that uses laser systems for automatic grade control. Pertinent prior art relating to screeds is found in U.S. Class 404, subclasses 114–118, and relevant prior art automatic grade control devices are found in Class 404, Subclasses 84.1, 84.5.

2. The Prior Art

As plastic concrete is placed during construction, it must be appropriately finished to give it a smooth, correctly textured surface. Numerous finishing devices, including screeds, have long been in use throughout the industry for treating plastic concrete. Known prior art systems include "bull" floats, finishing boards, strikeoffs, pains, plows, blades, and the like. A bull float typically comprises a flat, wooden board attached to a handle, much like a broom handle. These floats are manipulated by a single worker. Strikeoffs initially contact the jagged and irregular surfaces of unfinished plastic concrete with a rigid edge to initially form, level, and grade. In addition, modern screeds use powered vibrators to vigorously vibrate the screed. Vibration helps settle the concrete and eliminate entrapped air voids. Further, vibrational screeding densifies and compacts freshly poured concrete, drawing out excess water and increasing the resultant structural integrity.

Large cable-pulled, vibrating screeds extend between and rest upon the forms between which the plastic concrete is actually confined. Such screeds often employ automatic grade controlling apparatus responsive to an external laser source for leveling the surface. Smaller floating screeds do not ride on forms, since they are lightweight and they not sink deeply into the wet concrete. Such lightweight, portable screeds can be controlled by a single worker, and they are relatively easy to transport and deploy at the job. Even smaller floating screeds are equipped with powered vibrators.

A prior art, self-propelled "triangular truss" screed that rides upon forms, is seen in U.S. Pat. No. 4,349,328. U.S. Pat. No. 4,798,494 discloses a floating vibratory screed that finishes concrete with or without forms. U.S. Pat. Nos. 4,316,715, 4,363,618, and 4,375,351 are also relevant to the general technology discussed herein. All the above patents have been assigned to the same assignee as the present case.

U.S. Pat. No. 5,288,166, issued Feb. 22, 1994 and owned by the same assignee as in this case, discloses an automatic grading control screed having a transverse finishing mechanism transported by skis. Vertical supporting towers support the skis at periodic intervals. Each tower comprises a pair of stanchions disposed on opposite sides of the finishing tool. Suitable control cylinders raise and lower the stanchions to elevate or lower the tool and control finishing level. Tile cylinders are controlled by a beacon laser.

U.S. Pat. No. 5,328,295 owned by Allen Engineering Corporation discloses a finishing tool controlled by towers comprising a pair of extensible, spaced-apart stanchions hinged to lower skis. Suitable cylinders associated with each tower control elevation. Laser sensors detect a preestablished laser beacon for automatic level control.

U.S. Pat. Nos. 4,650,366 and 4,386,901 disclose screeds capable of formless, self-supporting or floating operation. The latter reference discloses a relatively heavy triangular truss screed adapted to be operated by two workers without the use of forms. U.S. Pat. No. 4,650,366 discloses a lightweight, portable-vibrating screed including a central, extruded beam element.

Another prior art floating screed of general relevance is disclosed in a video tape produced by the American Concrete Institute and The Portland Cement Association, entitled "Finishing Concrete Flatwork," that bears a Copyright date of 1984. Other prior art screeds, generally of the "form-riding" type, include those screeds disclosed in U.S. Pat. Nos. 4,340,351; 4,105,355; 2,651,980; 2,542,979; 3,095,789; and 4,030,873.

Lasers are commonplace on the modern construction site. They are employed in surveying, earthwork, and general layout operations. U.S. Pat. No. 4,861,189 and 4,854,769 disclose a system for paving inclined and/or curved surfaces. This system employs anchor vehicles and paving vehicles. The paving vehicles are secured to the anchor vehicles by wires. The connections of the wires to the anchor vehicles are controlled by a laser-sensing device. Microcomputers control the shape of the paving devices to create compound and complex curves in paved surfaces.

Devices employing a vehicle with a boom terminating in a screed are disclosed in U.S. Pat. Nos. 5,039,249 and 4,930,935. Each of these patents relates to an anchor vehicle and a telescoping boom extending horizontally from the vehicle. The boom terminates in a screeding device that may also employ augers and vibrators.

U.S. Pat. No. 4,978,246 discloses an apparatus and method for controlling laser-guided machines.

U.S. Pat. No. 4,752,156 discloses a manually operated laser guided portable screed having a pair of laser sensors. Screed height is established in response to a signal from the laser sensor. The above mentioned devices use a stationary laser beacon that projects laser light in a 360 degree plane.

Known prior art screeding devices tend to be either relatively large, heavyweight machines that are cable driven over forms, or relatively smaller one-person devices that, while lightweight and portable, lack many features found previously on larger units. There exists a need for a "middle-of-the road" screed that is lightweight and portable, but which accommodates automatic grade control laser leveling. A suitable portable automatic grade control screed may be handled by up to two workers without cables or winches.

SUMMARY OF THE INVENTION

Our new automatic grade control screed is user transformable between different configurations. In the best mode our new screed is operated by a pair of workers. Alternatively, the two person screed may be quickly transformed into a pair of single person machines by simply disconnecting the main screed spans. Whether the screed is used as a two-person screed or deployed for single person use, the latter feature aids in transportation and storage.

While light and portable, it is highly efficient on relatively large pours including roof decks, driveways and the like. A laser system maintains proper level and grade by signaling the workers. Suitable vibrators are provided at spaced apart locations to consolidate the concrete. The screed is manually drawn through rough, freshly-placed concrete for leveling and striking off. The preferred screed comprises an elongated float of channel aluminum abutting an elongated strikeoff that faces the workers. The screed preferably comprises a pair of spaced apart work stations, each equipped with an adjustable handle for the operator. The handles pivotally connect to vibrator assemblies that can be quick connected to the frame. The vibrator assemblies are powered by internal combustion motors that can be elevated above the float if desired or mounted directly on it.

Preferably an upright stanchion is mounted adjacent each vibrator assembly to secure a suitable laser sensor. Each sensor stanchion is secured by a vibrationreducing mounting formed from a trio of resilient buffers. A remote, elevation-monitoring laser system activates the sensors to measure grade. The sensors provide grade information to suitable indicators mounted on the handles. The workers can manually establish a precision laser-controlled grade by suitably adjusting the screed with their handles in response to the indicator display- no ski assemblies are required for the latter function.

Fully automatic grade control is established by optional ski assemblies that are quick-connected to the screed. The skis track within the wet concrete on the subgrade. The float is elevated above the skis by suitable screw jacks that can extend or retract. When the ski assemblies are deployed, the laser system activates the screw jacks to control the grade. In response to extension or retraction of the screw jacks, the elevation of the screed over the subgrade is precisely controlled.

In the best mode, low voltage, low power screw jacks are employed. They are powered by a suitable light-weight power source are carried in special backpacks worn by each worker. Low voltage electrical connections extending between the backpacks and the screed handles provide power for the laser receiving equipment and the screw jacks during automatic grade control operations.

Thus a fundamental object of our invention is to provide a relatively light weight, formless, floating vibrating screed of the character described that is capable of precision grade control.

Another very important object of our invention is to provide a portable screed of the character described that is transformable between a variety of configurations.

Another basic object is to provide a floating, vibrating screed of the character described for striking-off and float-finishing concrete without forms.

A further object is to provide a screed that bridges the gap between large, form-riding, cable-pulled vibrating screeds and smaller, one person floating screeds.

Another object is to equip a floating screed with a Laser grade control system that can be used with or without optional ski assemblies.

Another desirable object is to provide an automatic grade control screed that is easily used by a pair of workers without forms, cables, or winches.

Another important object is to provide a small floating screed that can be quickly transformed between one person and two person configurations.

A still further object is to provide a portable, vibrating screed of the character described that can be quickly fitted in the field with supporting ski assemblies for fully automatic grade control operations.

A still further object is to place concrete slabs on grades and extremely large areas without forms.

Another object is to finish large areas of plastic concrete with a minimum of equipment such as forms, cables, or winches.

Yet another object is to provide a portable, floating automatic grade control laser screed of the character described that accurately establishes enhanced floor flatness levels (i.e., "ff" of approximately 30 or better). Our new floating screed can finish a large slab to a flatness level of ±0.125 inches in ten foot stretches.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
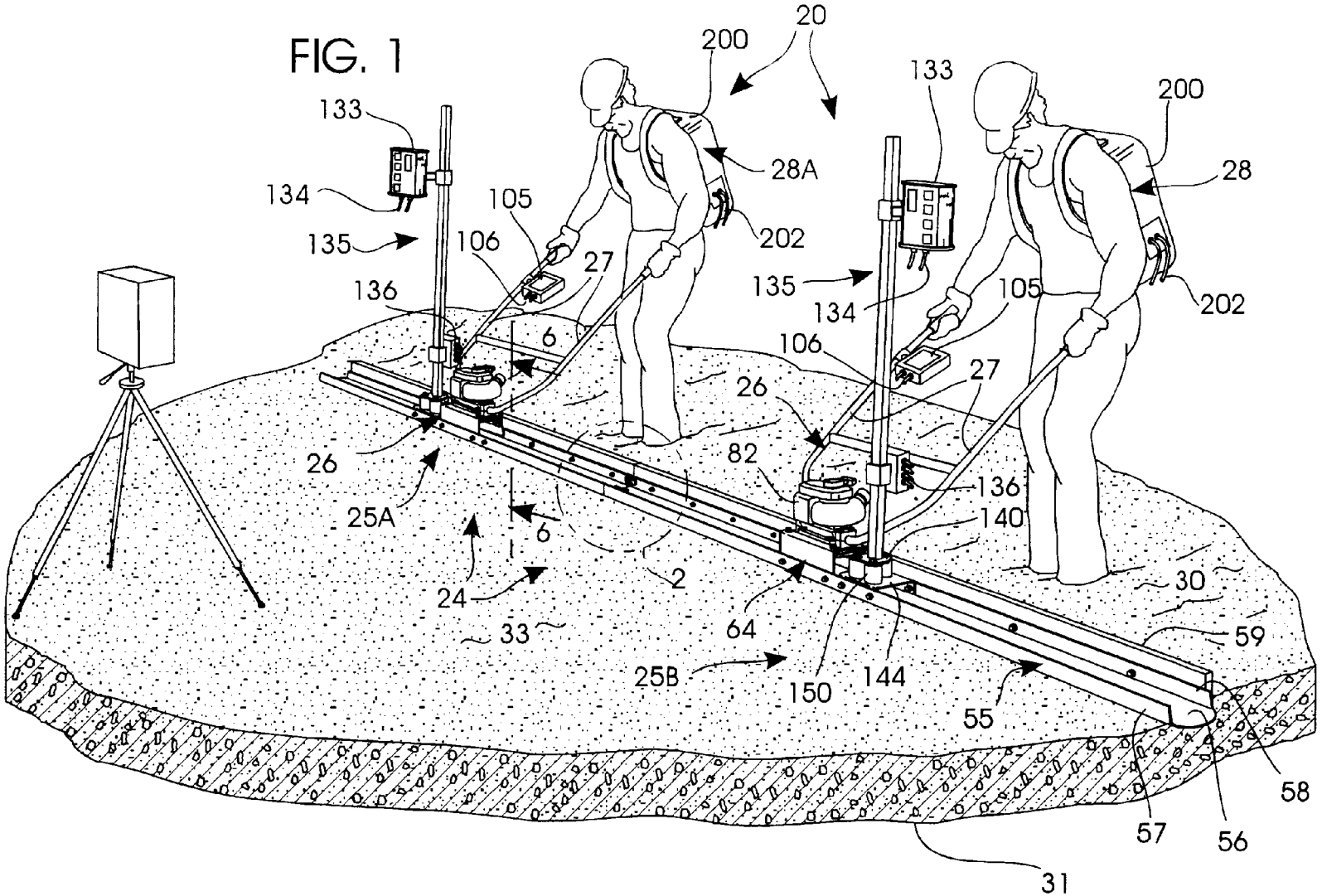
FIG. 1 is a fragmentary pictorial view of our preferred floating screed shown in use without the optional ski assemblies.
Figure 2:
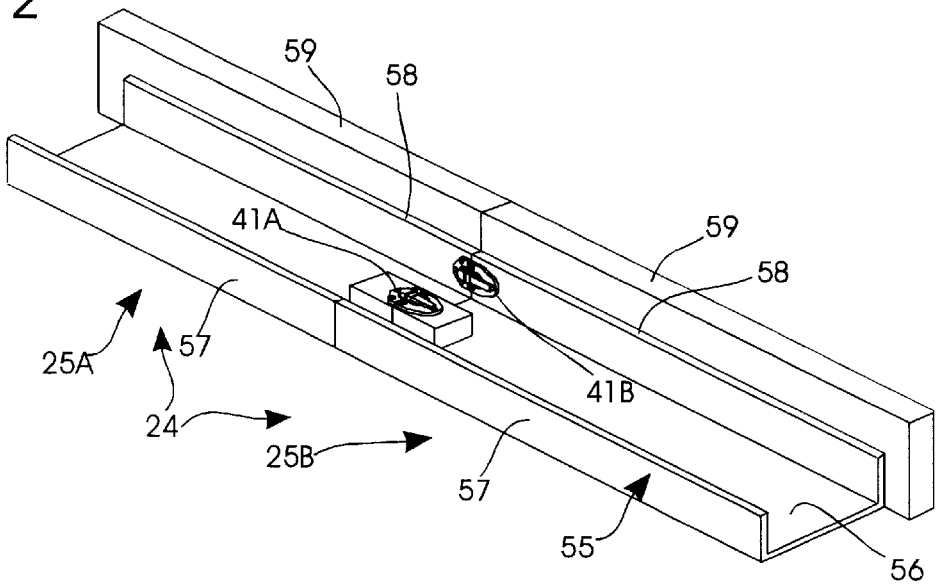
FIG. 2 is an enlarged, fragmentary perspective view taken generally from line 2—2 of FIG. 1, with portions thereof broken away for clarity.
Figure 2A:
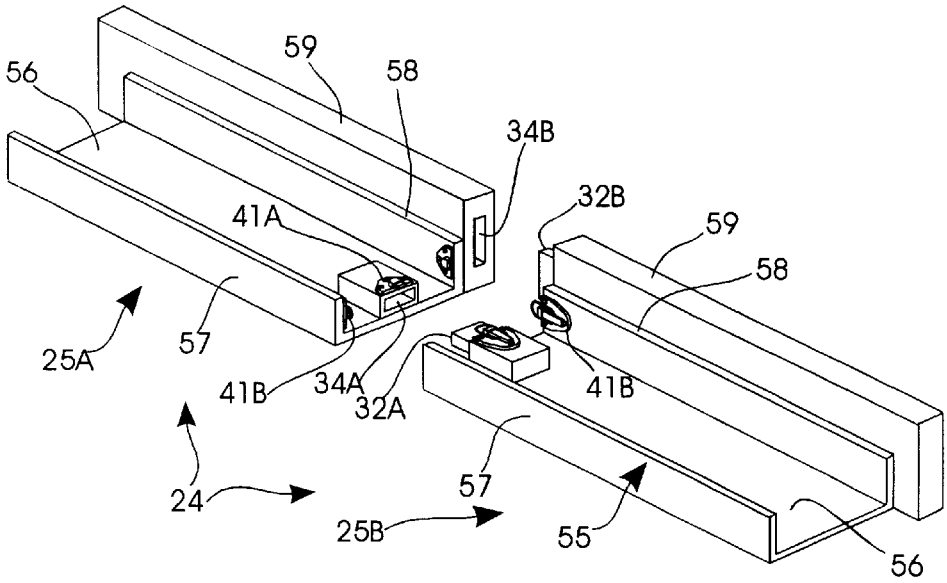
Figure 3:
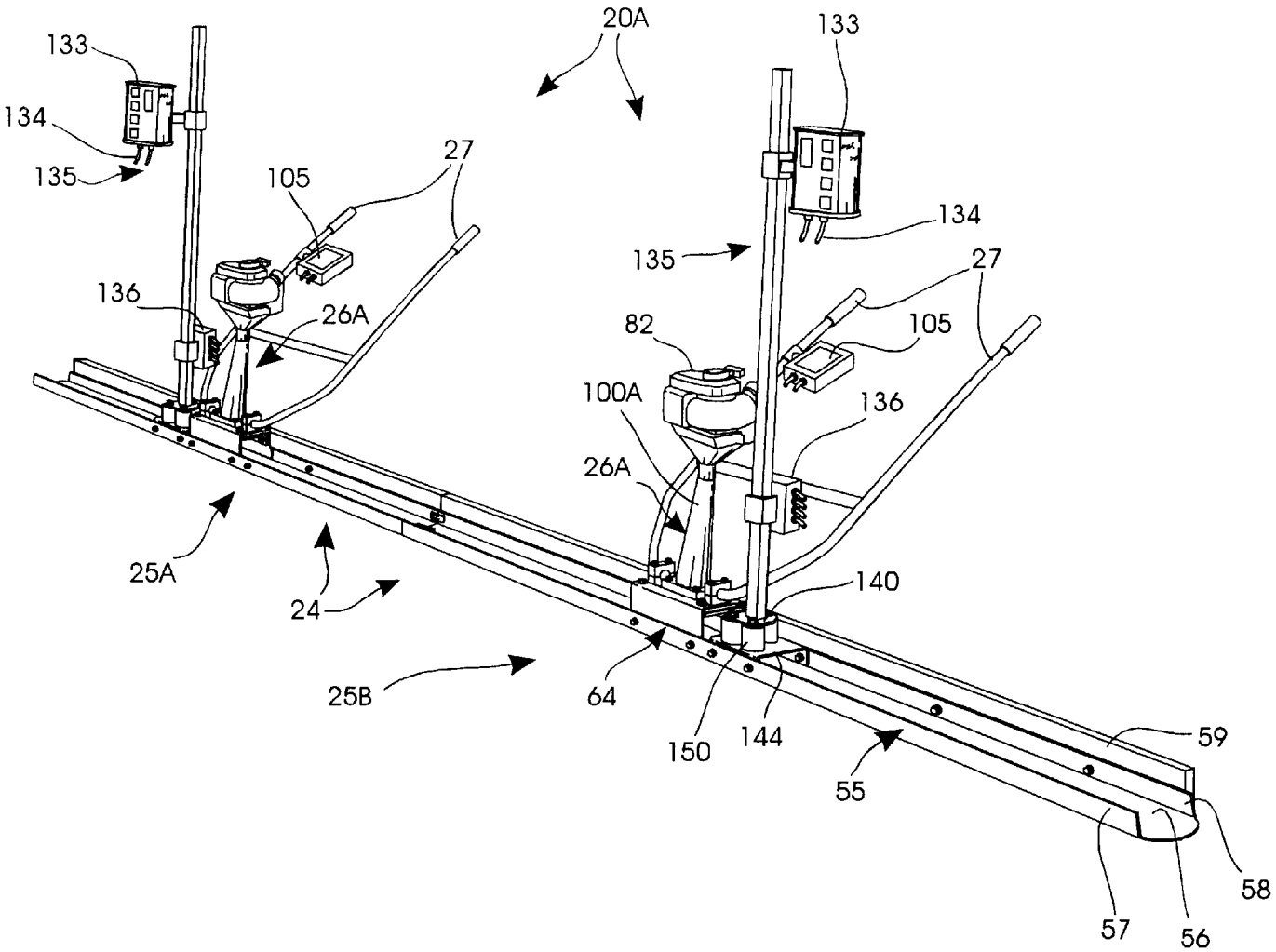
FIG. 3 is a rear perspective view of an alternative embodiment of the preferred screed, wherein the elevated vibrator motors are elevated, and wherein the optional ski assemblies have not been installed.
Figure 4:
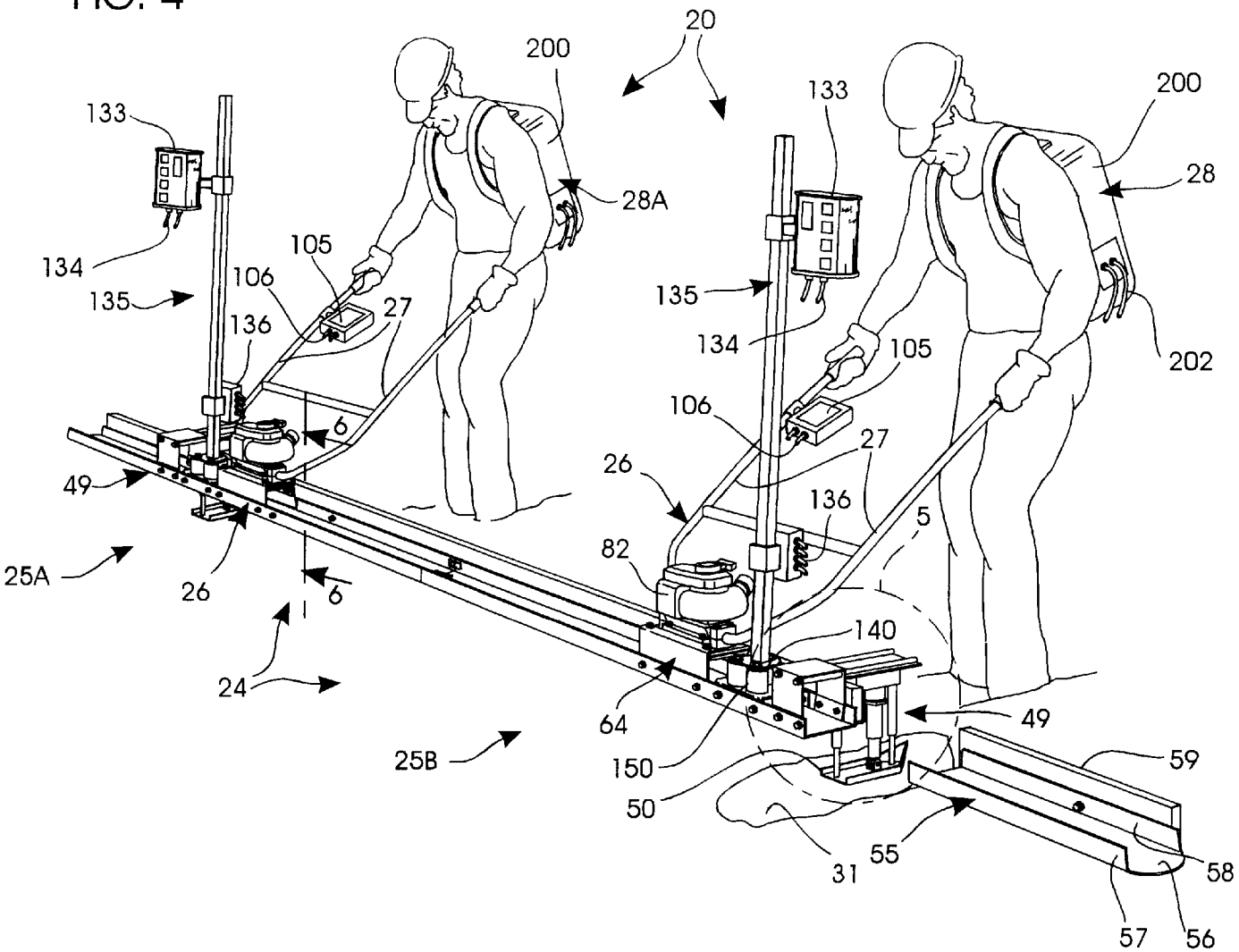
FIG. 4 is rear perspective view of a preferred screed, showing the optional light weight, laser-controlled grade control ski system.

With initial reference directed to FIGS. 1–2A of the appended drawings, the preferred embodiment of our new floating screed is broadly designated by the reference numeral 20. Screed 20 comprises an elongated float 24 of a generally L-shaped cross section equipped with separate vibrator assemblies 26 that are spaced apart along the length of screed 20. Each vibrator assembly supports a handle 27 for workers 28, 28A (FIG. 1, 4). The handles 27 are grasped by the workers to pull the screed 20 over rough, unfinished concrete 30. As the screed 20 is manually drawn through plastic concrete by the workers, it strikes off and levels the surface. Screed 20 also establishes a desired grade with little variation, yielding a finished area 33 of smoother concrete with improved flatness. Screed 20A is similar to screed 20, but it uses vibrator assemblies 26A having elevated motors (FIG. 3). As hereinafter explained in detail, screed 20 derives grade information from a remote laser that is displayed on indicators visible to the workers, who may then manually adjust grade with the handles. Screed 20 (FIG. 4) has been fitted with optional ski assemblies 49 that automatically adjust screed height for grade control in response to laser signals.

Screed 20 floats upon the concrete surface above the subgrade 31 (FIG. 1). As the screed 20 is manually drawn through plastic concrete by the workers 28, 28A, it strikes off the concrete, and additionally establishes a desired grade with little variation. After preliminary screeding is finished, and while the concrete slab is still green, suitable power trowels will fine finish the slab, as recognized by those skilled in the art. Laser sensing is employed for grade determination and control. Aspects of the laser configuration and the sensor arrangement are explained in detail in prior U.S. Pat. Nos. 5,288,166, issued Feb. 22, 1994, and 5,328,295 issued Jul. 12, 1994 which are hereby incorporated by reference. As in the aforementioned references, the selected finishing tool is controlled by relative extension and retraction.

Figure 6:
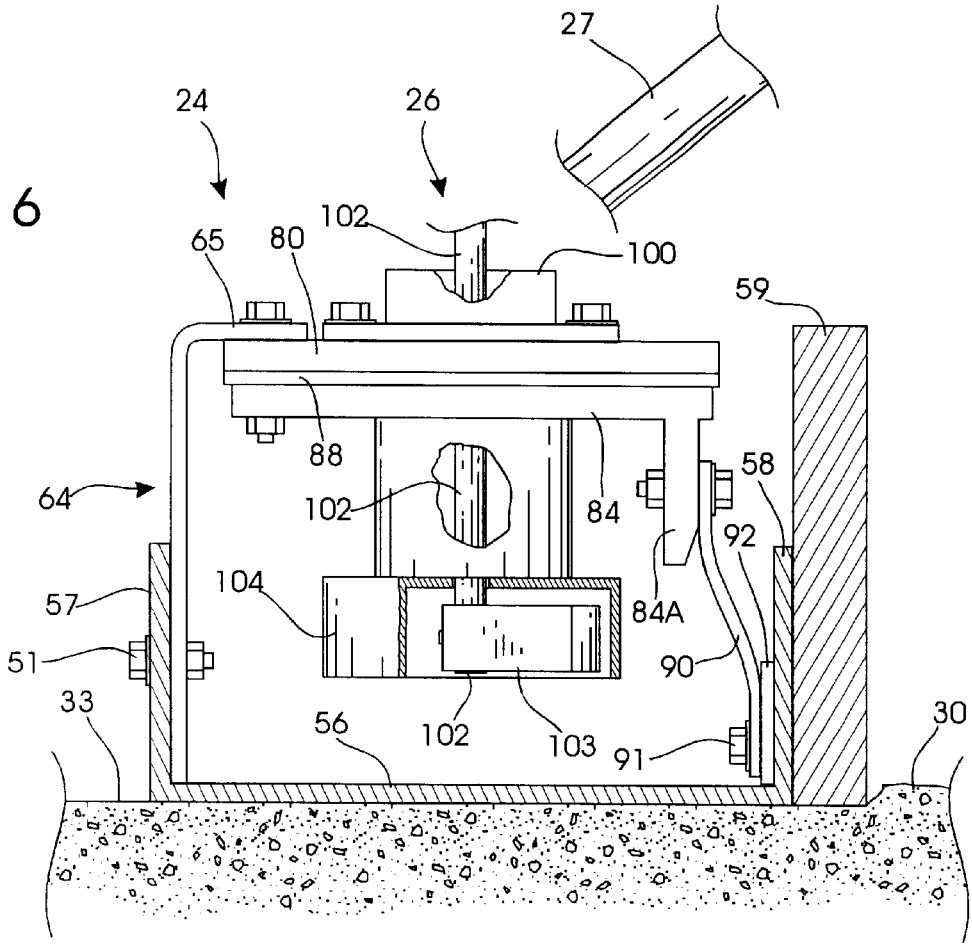
FIG. 6 is an enlarged, fragmentary sectional view taken generally along line 6—6 in FIG. 4; and, FIG. 7 is a fragmentary perspective view of a preferred vibrator assembly.
Figure 7:
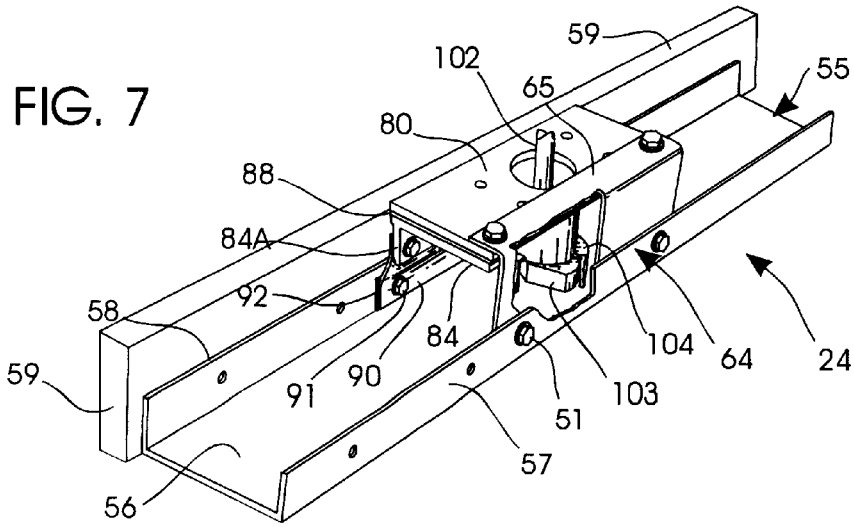

The preferred float 24 comprises an elongated pan 55 formed of aluminum channel extrusions. A flotation volume is defined between the flat inner surface 56 and the integral, upturned edges 57, 58 (FIG. 7). The upturned front pan edge 58 faces the workers during use. It is rigidly coextensive and parallel with an elongated strikeoff 59 that first contacts freshly poured, unleveled concrete. Preferably strikeoff 59 comprises aluminum bar stock of a generally rectangular cross section. In the best mode its cross section measures one inch by four inches. Strikeoff 59 makes initial contact with the wet concrete as the screed is pulled along by the workers, and its relative height compared to edge 58 (FIG. 6) normally prevents rough concrete from dropping into the pan interior.

As best seen in FIGS. 1 and 3, each two-person screed 20, 20A breaks down into twin one-person sections. For example, float 24 breaks down into separate half sections 25A, 25B that can be used as one person floating screeds. With reference to FIG. 2 and 2A, these separate sections 25A, 25B comprise male and female portions associated with pan 55 and strikeoff 59 that are adapted to be mated together in the field. It is preferred that rigid, rectilinear projections 32A, 32B extend outwardly from the pan half section 25B for fitting within corresponding receptacles 34A, 34B on the end of pan half section 25A. The flat inner surface of float 24 support projection 32A and companion receptacle 34A. The strikeoff projection 32B is firmly seated within companion receptacle 34B in the adjoining strikeoff section when the pieces are joined. A pair of rigid, clamps 41A and 41B secure the sections together when desired. Clamp 41A controls pans 55, and clamp 41B joins the adjacent edges 57, 58 of float sections 25A, 25B.

The vibrator assemblies 26 (FIG. 1) and 26A (FIG. 3) quick-connect (or quick disconnect) to float 24 (or to the various float sections 25A, 25B). A mounting bracket 64 (FIGS. 6, 7) having a generally L-shaped cross section is rigidly fastened to pan edge 57 with nut and bold fasteners 51. Bracket 64 comprises an integral, horizontally projecting support 65 that is parallel with and spaced apart from pan flat surface 56. Support 65 secures vibrator assembly 26. As seen in FIGS. 6 and 7, the preferred vibrator assembly comprises a rigid, generally rectangular frame 80 that supports a motor 82 that can be elevated if desired (FIG. 3). A somewhat L-shaped casting 84 (FIG. 6) is secured to the underside of frame 80 by suitable fasteners, with a resilient dampener pad 88 sandwiched therebetween. Leg 84A of the casting projects downwardly into pan 55, parallel with front edge 58 (FIG. 6). It is fastened to a resilient dampener 90 that is secured at its bottom to a spacer 92 and front edge 58 by fastener 91.

The motor 82 is mounted above the vibrator assembly 26 by a hollow mounting tube 100. Tube 100 is relatively short in FIGS. 1 and 6. However, screed 20A in FIG. 3 uses a larger, longer mounting tube 100A to substantially elevate the motors 82. In each case a drive shaft 102 (FIGS. 6,7) projects coaxially downwardly through tube 100 or 100A towards the float interior, terminating in a rotatable, eccentric weight 103 shrouded within protective enclosure 104. Weight 103 vibrates vigorously in response to rotation of shaft 102.

The draw handles 27 are pivotally connected to the vibrator assembly frame 80 so that they may be adjusted in elevation as desired by the workers. Handles support an electronic readout indicator 105 that displays grade in response to the laser system. By manually adjusting the handle positioning, displayed grade control information on screed 20 and 20A can be utilized by the workers for manual grade adjustments. Control wires 106 run from indicator 105 to control box 136. Both operators make finite adjustments in the orientation of the screed 20 by adjusting the handle as suggested by the indicator readout. The vibrator assembly is commercially available under the trade name "Magic Screed."

Figure 5:
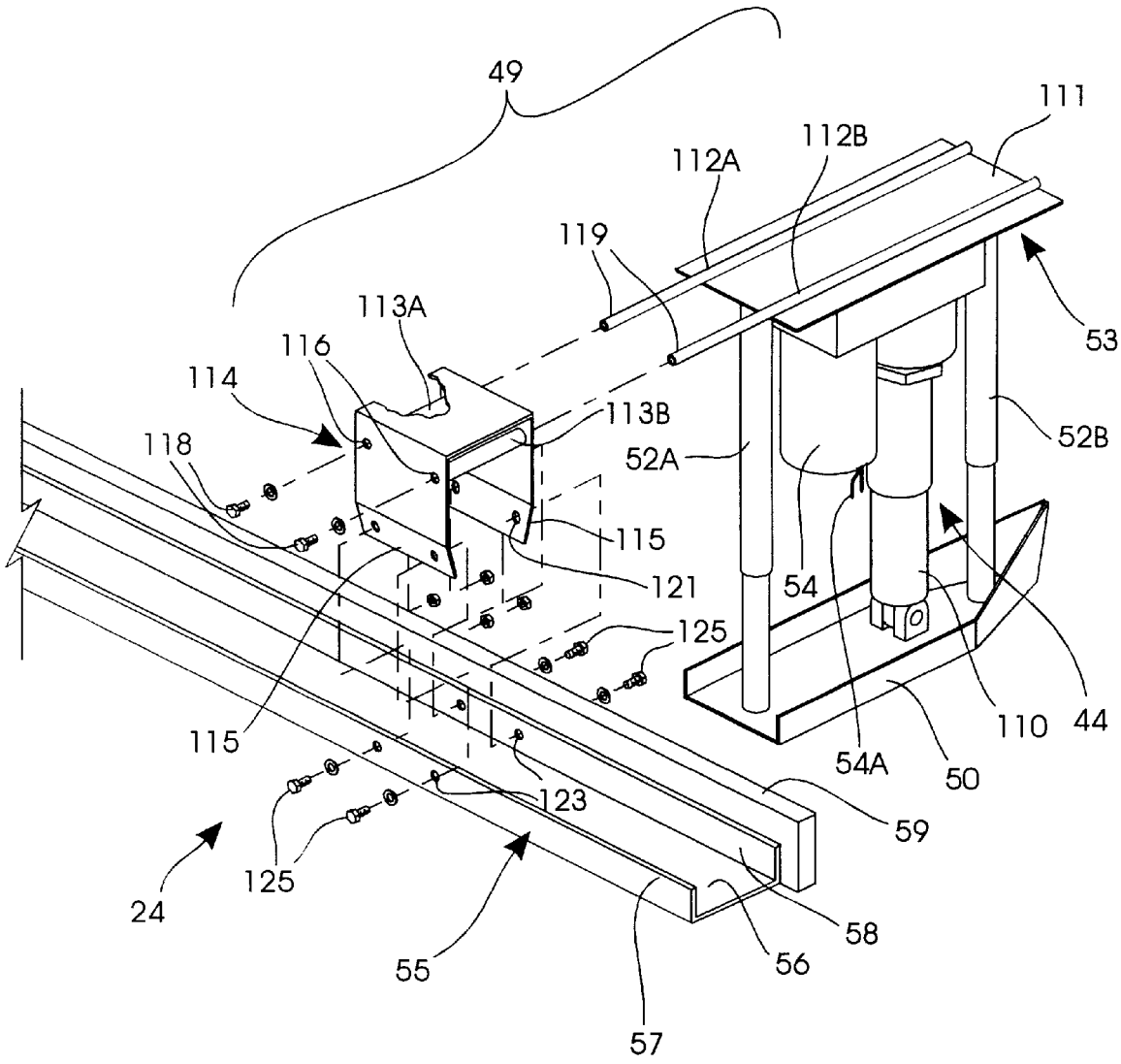
FIG. 5 is an enlarged, fragmentary, partially exploded perspective view taken generally from line 5—5 of FIG. 4, showing the removable ski assembly.

The preferred removable ski assembly 49 (FIG. 5) quick connects or quick disconnects from the float 24. In screed 20 (FIG. 4) a pair of ski assemblies 49 have been quick connected to float 24. A lower ski 50 supports an upwardly projecting screw jack 44 (FIG. 5), which comprises a rigid, downwardly projecting ram 110 pivoted to ski 50. The screw jack 44 is supported by upper subframe 53. Subframe 53 forms the top of ski assembly 49. Linearly extensible stabilizer slides 52A, 52B on opposite sides of the screw jack 44 extend between the ski 50 and the upper subframe 53. The screw jack motor 54 is connected via wires 54A to a controller 136 coupled to a remote power source. The power source preferably comprises batteries in suitable backpacks 200 transported by workers 28, 28A. Connecting rods 112A, 112B project away from a rigid cover plate 111 on top of subframe 53 to removably mount the ski assembly 49 to float 24. Rods 112A, 112B coaxially penetrate suitable mating sleeves 113A and 113B (FIG. 5) respectively traversing sides of a rigid brace 114. The downwardly depending, inturned edges 115 of brace 114 surmount float 24 (FIG. 5). The outermost ends 119 of rods 112A, 112B, are coaxially secured within sleeves 113A, 113B in brace 114 by suitable bolts 118. Bolts 118 penetrate orifices 116 and threadably engage rod ends 119. Edges 115 on brace 114 have lower mounting orifices 121 that register with float orifices 123 formed in float edges 57, 58. Fasteners 125 (FIG. 5) secures brace 114.

The laser system is preferably a conventional design such as Models LB-1 or LB-4 offered by Laser Alignment Inc. The beacon is deployed using a benchmark reference to establish a fixed elevation. Laser signals reach sensors 133 that are deployed on special sensor stanchions 135. Stanchions 135 are welded to a suitable plates 140 that are coupled to channel shaped brackets 144 disposed between float edges 57, 58. Preferably a trio of generally cylindrical isolator dampeners 150 are sandwiched between plate 140 and bracket 144 to attenuate potentially injurious vibrations. Wires 134 extend from sensors 133 to control box 136. Power is ultimately obtained from the portable power supplies disposed within the worker backpacks 200.

With the ski assemblies 49 attached, the elevation of float 24 above subgrade 31 is automatically controlled by the laser system. Although elevation information is displayed on the handle indicators 105, it is not necessary for the workers to continually monitor these indicators as fully automatic grade control screeding progresses.

It is preferred that each worker 28, 28A wears a backpack 200 that contains a portable power source. In the best mode known at this time this would comprise either a portable generator or a small, deep charge battery. Wires 202 lead from the backpack interiorly through the handles 27 to control box 136. The relay within control box 136 is controlled by the aforedescribed laser system to supply approximately twelve volts of direct current to the DC motors 54 within the screw jacks 44. The relays reverse the polarity as necessary to raise or lower the screed float section over the concrete. By carrying the low voltage direct current power source for powering the lightweight, and low power screw jacks, the worker can avoid the inconvenience of long electric extension cords and the shock hazard present when high voltage electricity is used in hostile, wet conditions.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A floating screed for treating plastic concrete that can be switched between a single large screed requiring two person operation or twin separate screeds allowing single person operation, said screed comprising:

an elongated concrete finishing float adapted to be floated upon said concrete above a subgrade, said float comprising strike-off means for cutting, striking off and leveling rough, uneven freshly poured concrete, wherein the finishing float comprises twill sections and clamp means for normally holding the twin sections together for two person operation, the clamp means enabling the twin sections to be separated to transform the screed into twin single-operator floating screeds;

vibrator means for vibrating said float and said concrete to smooth and settle the concrete;

a laser-operated, automatic grade control apparatus comprising a remote source of laser light, and sensor means for receiving said light mounted to the screed;

quick connect ski means for supporting the screed above the subgrade, said ski meals comprising a ski riding on the subgrade and screw jack means mechanically extending between said ski and sad screed for controlling the elevation of the finishing float above the concrete by extending or retracting in response to said sensor means, wherein said quick connect ski means comprises connecting rods, mating sleeves to which said connecting rods are removably coupled, and said ski means comprises a pair of extensible stabilizer sleeves, one disposed on each side of said screw jack means; and, a pair of spaced apart control handles, one for each worker.

2. The screed as defined in claim 1 further comprising backpacks worn by the workers and a portable power source disposed within said backpacks worn by the workers for powering the screw jack means.

* * * * *